US005634181A

United States Patent [19]

Tachibana et al.

[11] Patent Number: 5,634,181

[45] Date of Patent: May 27, 1997

[54] DEVELOPING APPARATUS

[75] Inventors: Hidekiyo Tachibana; Yutaka Toyoda; Masashi Kajimoto; Mikio Yamamoto, all of Kanagawa, Japan

[73] Assignee: Fuji Xerox Co., Ltd., Tokyo, Japan

[21] Appl. No.: 196,834

[22] Filed: Feb. 15, 1994

[30] Foreign Application Priority Data

Feb. 16, 1993 [JP] Japan ..... 5-026769

[51] Int. Cl.[6] ..... G03G 15/08

[52] U.S. Cl. ..... 399/254; 399/281; 399/285; 430/120

[58] Field of Search ..... 355/245, 260, 355/251, 253, 246, 259; 430/99, 120, 106.6; 118/652, 653, 657, 658

[56] References Cited

U.S. PATENT DOCUMENTS

| | | | |
|---|---|---|---|
| 2,297,691 | 10/1942 | Carlson . | |
| 2,874,063 | 2/1959 | Greig . | |
| 2,895,847 | 7/1959 | Mayo . | |
| 3,713,819 | 1/1973 | Hagenbach et al. | 430/106.6 X |
| 3,866,574 | 2/1975 | Hardenrook . | |
| 3,929,098 | 12/1975 | Liebman . | |
| 3,956,108 | 5/1976 | Young | 209/10 |
| 4,267,247 | 5/1981 | Ziolo et al. | 430/120 |
| 4,561,381 | 12/1985 | Kaneko et al. | 118/652 |
| 4,816,870 | 3/1989 | Nagayama | 355/245 |
| 4,937,627 | 6/1990 | Ozawa et al. | 355/260 |
| 5,012,288 | 4/1991 | Tavernier et al. | 355/259 |
| 5,095,850 | 3/1992 | Komuro | 118/657 |
| 5,287,148 | 2/1994 | Sakomi et al. | 355/245 |
| 5,441,177 | 8/1995 | Yanagisawa | 222/167 |
| 5,474,869 | 12/1995 | Tomita et al. | 430/102 |

FOREIGN PATENT DOCUMENTS 54-51848 4/1979 Japan .

*Primary Examiner*—William J. Royer

*Attorney, Agent, or Firm*—Finnegan, Henderson, Farabow, Garrett & Dunner, L.L.P.

[57] ABSTRACT

A developing apparatus in which a nonmagnetic carrier is used; a developer forward member having a conductive surface and forwarding a nonmagnetic toner and the resin carrier by stirring is disposed so as to confront a toner carrying body with a gap interposed therebetween and so as to arrange a part of the surface thereof close to an inner wall surface of a frame of the apparatus, the frame having a surface profile corresponding to a surface profile of the forward member; and a voltage applying means is arranged so that the voltage applying means applies such a voltage to generate an electric field for attracting the toner in the developer toward the toner carrying body and attracting the resin carrier toward the developer forward member in the area where the toner carrying body confronts the developer forward member.

20 Claims, 3 Drawing Sheets

DEVELOPING APPARATUS

BACKGROUND OF THE INVENTION

1. Field of the Invention

The present invention relates to a developing apparatus that develops an electrostatic latent image formed on an electrostatic latent image carrying body using a nonmagnetic toner in electrophotographic copying machines, printers, and the like.

2. Description of the Related Art

U.S. Pat. No. 2,297,691 discloses an electrophotographic method of forming an electrostatic latent image by exposing an image to a photosensitive body having a photoconductive insulating layer that is electrically charged uniformly and then rendering such electrostatic latent image into a visible image by causing, e.g., fine powdered electrically sensitive particles called toner to adhere thereto.

U.S. Pat. No. 2,874,063 discloses a typical magnetic brush development method that uses a two-component developer comprising a toner and a carrier which is made of magnetic particles such as brown ion oxide, ferrite or the like. The toner in the developer is electrically charged by friction at the time the carrier and the toner are being stirred and the like. The electrically charged toner is then held by magnetic attraction of a magnet contained in a developing roll so that the toner particles are oriented so as to be brushlike in the presence of a magnetic field of the magnet at a position where the toner particles confront the photosensitive body. Such magnetic brush comes in contact with an electrostatic latent image formed on the photosensitive body, and the toner in the developer adheres to the photosensitive body to develop an image.

The above-mentioned magnetic brush development can impart sufficient electric charge to the toner in the developer, and the toner can be supplied to the developing roll stably. Therefore, this development method is successful in producing uniform and satisfactory image quality at the initial state of copying. However, in the case of development for several tens of thousands of copies (e.g., copying operations), problems such as reduction in image density, fog in background areas and the like are addressed. The reason therefor is ascribed to the fact that the developer is subjected not only to magnetic attraction of the developing roll but also to compression or shearing due to collision during stirring or to reduction in the capability of the carrier to electrically charge the toner due to the surface of the carrier being contaminated either by the toner or an externally added agent used as an electric charge control agent or a fluidity imparting agent.

Further, the magnetic brush development method that causes the magnetic brush to contact the electrostatic latent image on the photosensitive body as described above produces sweep pattern by the rubbing of the toner image first developed on the photosensitive body when applied to a full color copying machine, thereby imposing the problem of not implementing high-quality color copying.

On the other hand, U.S. Pat. No. 2,895,847 discloses another electrophotographic development method as a touchdown development method which is designed to hold a nonmagnetic toner on a toner carrying body called donor and effects development with the toner contacting or not contacting an electrostatic latent image. As a touchdown development method, U.S. Pat. No. 3,866,574 discloses a technique characterized as generating an AC electric field in a development area for development by noncontact with the photosensitive body. Unexamined Japanese Patent Publication No. Sho. 54-51848 discloses a method that a layer forming member comprising a soft elastic body is compressedly contacted on the surface of the donor.

Since the touchdown development methods allow development to be effected with the toner on the donor in thin layer form adhering to the photosensitive body in a noncontact manner, it has an advantages to be possible to produce high-quality color copies. However, the touchdown development methods still have the following problems.

In the touchdown development methods without the magnetic carrier as in the magnetic brush method, the toner cannot ensure supply, to the donor causing erratic image density. Further, because only a triboelectricity at a portion where the donor contacts compressedly with the layer forming member is for charging the toner, a small amount of electric charge is stored, whereby a so-called "high γ image" in which the reproduced image density is lower than that of the original or the toner splashes to dirty the machine body. Still further, in forming a layer of the toner on the donor, the toner is subjected to stress and frictional heat as the toner passes through the area in which the donor comes in pressure contact with the layer forming member. As a result, an externally added agent such as an electric charge control agent or a fluidity imparting agent is hidden in the toner with the function thereof lost, thereby bringing about reduction in image density, fog in background areas, and the like.

To overcome the above-mentioned problems, U.S. Pat. No. 3,929,098 discloses a method for supplying a nonmagnetic toner onto the donor surface by the magnetic brush development method with a magnetic carrier. That is, as shown in FIG. 1, this development method involves the steps of: forwarding a developer composed of a nonmagnetic toner a and a magnetic carrier b with the developer being held on a developer forward member d having a built-in magnet roll c therein in the shape of a magnetic brush by magnetic attraction to a position where the developer confronts a donor (toner carrying body) e; delivering only the nonmagnetic toner a in the developer onto the donor e to form a layer by an electric field generated by a voltage applied from a power supply f across the developer forward member d and the donor e; and developing an electrostatic latent image of an electrostatic latent image holding body g by such toner a thereafter. In FIG. 1, reference characters h and i designate a developer forward stirring member and a frame of a developing apparatus, respectively.

According to this method, not only the nonmagnetic toner can be supplied to the donor stably, but also a uniformly thin layer can be formed by appropriately controlling the electric field for delivering the toner to the donor. However, there still remains unsolved problems that the apparatus becomes complicated and thus costly, and that the contamination of the carrier peculiar to the magnetic brush development method leads to a reduction in the toner charging amount and hence to a reduction in image density as well as fog in background areas.

SUMMARY OF THE INVENTION

An object of the present invention is to provide a small-sized and low-cost developing apparatus which is capable of supplying the nonmagnetic toner stably to the toner carrying body by being able to electrically charge it sufficiently, and does not generate the reduction of image density, fog in background areas and the like so as to perform satisfactory noncontact development.

To achieve the above object, a first aspect of the invention is applied to a developing apparatus that develops an electrostatic latent image on an electrostatic latent image holding body in a noncontact manner by a nonmagnetic toner carried on a toner carrying body disposed so as to confront the electrostatic latent image holding body. In such a developing apparatus, a nonmagnetic resin carrying body is used as a carrying body for the nonmagnetic toner; a developer forward member is disposed so as to confront the toner carrying body with a gap interposed therebetween and so as to arrange a part of the surface thereof close to an inner wall surface of a frame of the apparatus, the developer forward member having a conductive surface and forwarding a developer composed of the toner and the resin carrying body by stirring, the inner wall surface having a surface profile corresponding to a surface profile of the developer forward member; and a voltage applying unit for applying such a voltage as to generate an electric field for attracting the toner in the developer toward the toner carrying body and attracting the resin carrying body toward the developer forward member in an area where the toner carrying body confronts the developer forward member.

To achieve the above object, a second aspect of the invention is applied to a developing apparatus for developing an electrostatic latent image, which apparatus includes: a rotatable toner carrying means; a rotatable toner supply means for supplying a toner to the toner carrying means; a developer forward passage disposed around the toner supply means; and a electric field generating means for generating an electric field for delivering the toner to the toner carrying body from the toner supply means. In such a developing apparatus, the toner supply means contains therein a two-component developer having the toner and a carrying body and includes: a stirring area where the two-component developer is stirred; a forward force imparting area where a forward force is imparted to the two-component developer to allow the two-component developer to be supplied to the forward passage; and a toner supply area where the two-component developer is caused to confront the toner carrying body.

According to the developing apparatus of the present invention, the nonmagnetic toner is charged with triboelectricity while stirred by the developer forward member together with the resin carrier to have sufficient electric charge.

The colliding force among developer particles at the time of stirring the developer is weakened since the weight of the nonmagnetic resin carrier is much lighter than that of the conventional magnetic carrier formed by coating resin with brown iron oxide, ferrite, or the like. As a result, the amount of the externally added agent or the like adhering to the surface of the carrier is reduced, which keeps the resin carrier surface in an initially clean condition for a long period of time to ensure that the resin carrier maintains the toner charging capability at all times. Consequently the toner can be electrically charged sufficiently.

The developer including the electrically charged toner and resin carrier is forwarded so as to move through the gap between the developer forward member and the inner wall surface of the frame of the apparatus, finally reaching a position where such developer confronts the toner carrying body by the rotation of the developer forward member. Since an electric field is generated at the position where the developer forward member confronts the toner carrying body, the toner in the developer is delivered to the toner carrying body by the action of the electric field, thus allowing a uniformly thin layer of toner to be formed on the carrying body.

Since the toner can be supplied to the toner carrying body without using the magnetic brush development method, the magnet roll is unnecessary so as to make the apparatus significantly simple. Further, the resin carrier is nonmagnetic and the developer is thus not subjected to magnetic action as a whole, which leaves the carrier free from contamination by the externally added agent for the toner. This makes the toner readily responsive to the electric field, thereby causing a sufficient amount of toner to adhere to the forward member and the toner carrying body.

The toner adhered to the toner carrying body is forwarded to a position confronting the electrostatic latent image holding body by the rotation of the carrying body, and is caused to fly over toward and adhere to the electrostatic latent image on the electrostatic latent image holding body via development charges of the developing bias voltage applied across the carrying body and the electrostatic latent image holding body thereat, so that development is effected.

As described above, the developing apparatus of the present invention can effect development ensuring faithful, high-quality image reproduction without making the toner image formed on the electrostatic latent image holding body in advance messed up by the magnetic brush as in the magnetic brush development method since the development of the invention is effected in a noncontact manner.

BRIEF DESCRIPTION OF THE DRAWINGS

In the drawings;

FIG. 3(*b*) is a side view of the main portion of an exemplary developer forward member;

DETAILED DESCRIPTION OF THE INVENTION

Figure 1:
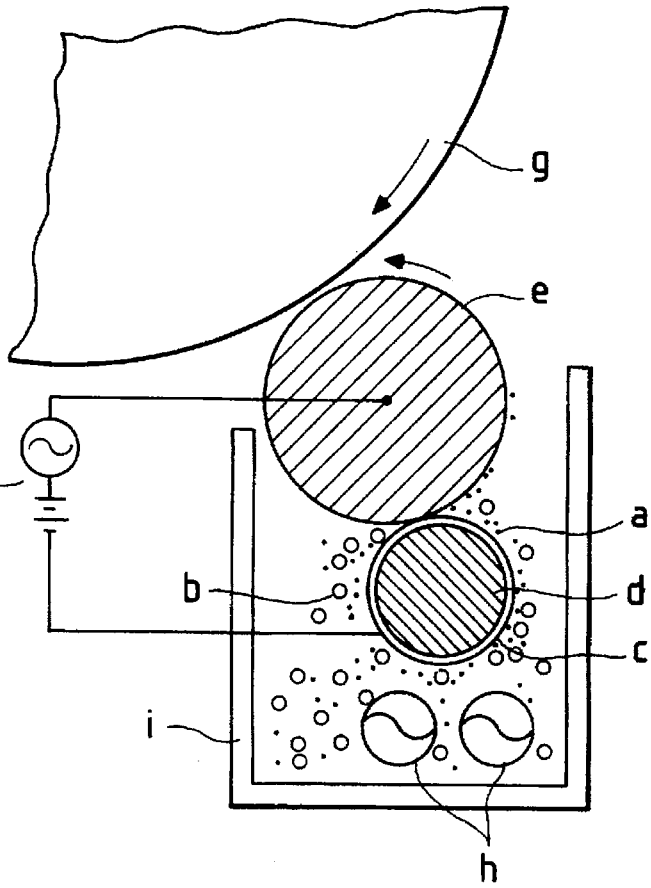
FIG. 1 PRIOR ART
FIG. 1 is a conceptional diagram showing a conventional image recording apparatus.

The detailed description of the invention will be described as follows.

In the present invention, a nonmagnetic toner is prepared by being rendered into particles, the particle diameter of which is from 3 to 20 μm, by pulverization and classification after a pigment such as carbon and a polarity control agent such as a metal-containing azo dye are dispersed into thermoplastic resin such as styrene resin, acrylic resin, or polyester; and then externally adding an electric charge control agent to the surfaces of the particles. As the electric charge control agent, silica, alumina, titanium, or the like, which is rendered hydrophobic and whose particle diameter is 0.1 μm or less, is used. Hydrophobic silica, among others, is most preferable.

Further, in the present invention, a nonmagnetic resin carrier is prepared by pulverizing resin such as styrene resin, acrylic resin, or polyester similarly to the toner, or polyethylene, polypropylene, or the like. The resin carrier may contain an electric charge control agent for electrically charging the toner to a desired polarity and a conductance imparting agent such as carbon. The resin carrier is used in such a ratio as to be 5 to 80% by weight with respect to the toner.

This resin carrier has a volume average particle diameter ranging from 30 to 500 μm, preferably from 40 to 150 μm. The inertial mass thereof is too small when the particle diameter is 30 μm or less since such resin carrier is devoid of magnetic force by which to cause itself to be attracted to the developer forward member. As a result, the resin carrier becomes cloudlike together with the toner, so as to be difficult to pass through the gap between the developer forward member and the toner carrying body satisfactorily to thereby make itself susceptible to adhesion to the toner carrying body, and cause the amount of toner delivered to the toner carrying body to be reduced. On the other hand, when the particle diameter of the resin carrier exceeds 500 μm, the resin carrier cannot pass through the gap between the developer forward member and the toner carrying body satisfactorily if such gap is 2 mm or less, hence again making itself susceptible to adhesion to the toner carrying body or causing the amount of toner delivered to the toner carrying body to be reduced.

Further, the apparent specific gravity of the resin carrier is from 1 to 3 g/cm$^3$. If the apparent specific gravity is less than 1 g/cm$^3$, the inertial mass thereof becomes too small, and therefore the resin carrier does not pass through the gap between the developer forward member and the toner carrying body satisfactorily as in the case where the particle diameter is too small. As a result, the resin carrier is made susceptible to adhesion to the toner carrying body, and the amount of toner delivered to the toner carrying body is reduced. On the other hand, if the apparent specific gravity exceeds 3 g/cm$^3$, since the externally added agent or the like tends to adhere to the surface of the carrying body within a short period of time, the toner is not electrically charged sufficiently. Metal powder such as ferrite may be added to the resin carrier in a small amount, to optimally adjust the apparent specific gravity. The addition of such magnetic metal powder is no hindrance to the operation of the invention.

Still further, the resin carrier has a volume resistivity ranging from $10^6$ to $10^{12}$ Ω·cm, preferably, from $10^6$ to $10^{10}$ Ω·cm. If the volume resistivity is less than $10^6$ Ω·cm, the conductivity of the resin carrier becomes so strong as to receive electric charge from the developer forward member (i.e., voltage leak occurs), thus making the resin carrier susceptible to adhesion to the toner carrying body. If the volume resistivity exceeds $10^{12}$ Ω·cm, the capacity of electrically charging the toner (the electric field for delivering the toner to the toner carrying body) is reduced, whereby the toner can not be delivered satisfactory from the developer forward member to the toner carrying body.

A developer forward member of the present invention is a cylindrical basic member having a plurality of openings on the circumference thereof at a regular interval, the cylindrical basic member being made of a conductive material such as aluminum. The basic member of the developer forward member has an outer diameter of about 10 to 20 mm, and the occupancy of the openings to the entire circumference is preferably about 50%. The openings may take any form.

In the present invention, the developer forward member is made cylindrical, in which two-component developer comprising the toner and carrier held therein is mixed and stirred in the cylinder with its rotation so that carrier particles impart a predetermined amount of electric charge to toner particles. The developer mixed and stirred in the cylinder is supplied to the developer forward passage from the openings disposed on the circumference of the cylinder. At this instance, the developer receives centrifugal force derived from the rotation of the cylinder as well as rotating force in the tangential direction of the rotation by the thickness of the opening. These forces act as a force for forwarding the developer along the developer forward passage. The developer forwarded along the developer forward passage is confronted with the toner carrying body in an area where no openings are on the circumference of the cylinder by the rotation of the cylinder. At this point of time, only the toner particles are delivered to the toner carrying body by the electric field that is designed to deliver only the toner to the toner carrying body, so as to be supplied for the development of the electrostatic latent image. On the other hand, the carrier particles that is electrically charged to a polarity opposite to that of the toner particles are returned to the toner supply unit through the openings.

This developer forward member is arranged so that a gap ranging from 0.5 to 2 mm, or preferably 1 mm or less, is interposed with respect to the toner carrying body. The developer forward member is rotated so that the circumferential Speed of the developer forward member becomes 0.5 to 5 times, or preferably 1 to 3 times that of a toner carrying body. The developer forward member is disposed close to a frame of the apparatus so that a part of the surface of the basic member thereof can be accommodated in an inner wall surface of the frame, the inner wall surface having a shape corresponding to the cylindrical shape. The gap between the forward member and the inner wall surface is about 0.5 to 3 mm, or preferably about 1 to 2 mm.

In the present invention, the voltage applying unit is designed to apply across the developer forward member and the toner carrying body such a voltage as to generate an electric field for attracting the nonmagnetic toner toward the toner carrying body and attracting the resin carrier toward the forward member. The voltage to be applied is either DC voltage of about 100 to 200 V or voltage obtained by superposing 100 to 2000 Vpp on such DC voltage. Since the above-mentioned electric field can be generated by applying such voltage, the nonmagnetic toner can be delivered to the toner carrying body to form on the toner carrying body such a thin toner layer as having about one to three layers of toner particles deposited thereon.

The toner carrying body of the present invention is formed of a roll whose diameter is usually 10 to 30 mm. Specifically, an aluminum or stainless steel round bar or pipe is cut, and then the circumference thereof is subjected to machining such as sandblasting, liquid honing, emerying, or to chemical etching to thereby leave the surface with asperities whose surface roughness Ra is in the order of from 0.1 to 1.0 μm; an aluminum or stainless steel round bar or pipe is cut, and then the circumference thereof is covered with a semiconductive layer made from phenol resin or the like and subjected to machining such as emerying to thereby leave the surface with asperities whose surface roughness Ra is in the order of from 0.2 to 0.4 μm; an aluminum roll is mechanically polished and then anodized; or the like. In the case of arranging a semiconductive layer, the volume resistivity of the toner carrying body in the direction of thickness is in the order of from $10^4$ to $10^{12}$ Ω·cm.

This toner carrying body is usually rotated at 100 to 300 rpm and development bias voltage is applied thereto. The bias voltage is 1000 to 4000 Vpp AC bias voltage with −50 to −400 V AC voltage superposed thereon. The frequency of the AC bias voltage is 1 to 10 kHz. Desirably, the peak value of the AC bias voltage divided by the gap between the toner carrying body and the electrostatic image holding body is within the range of 4 to 7 V/μm and the frequency thereof under such condition is 2.5 to 6.0 kHz.

The toner carrying body may have a regulating member that is attached compressedly onto the surface thereof if necessary. The role of the regulating member is not only to repeat the electrically charging of the toner and the forming of a thin layer of toner, since the toner delivered from the forward member to the toner carrying body is electrically charged sufficiently and is formed into a uniformly thin layer, but also to prevent the toner from being scattered outside the apparatus. Accordingly, the attaching force of the regulating member onto the toner carrying body may be an extremely small value, thereby preventing the biasing force from giving stress to the toner. The regulating member may be formed by adhesively vulcanizing silicon rubber or EPDM rubber to the top end of a stainless steel plate spring whose thickness is in the range of about 0.03 to 0.3 mm. Such regulating member is arranged under a contact pressure of about 2 to 20 g/cm to the toner carrying body.

In the present invention, the toner supply unit is made cylindrical, in which two-component developer held therein is mixed and stirred in the cylinder with its rotation so that carrier particles impart a predetermined amount of electric charge to toner particles. The developer mixed and stirred in the cylinder is supplied to the developer forward passage from the openings disposed on the circumference of the cylinder. At this instance, the developer receives centrifugal force derived from the rotation of the cylinder as well as rotating force in the tangential direction of the rotation by the thickness of the opening. These forces act as a force for forwarding the developer along the developer forward passage. The developer forwarded along the developer forward passage is confronted with the toner carrying body in an area where no openings on the circumference of the cylinder by the rotation of the cylinder. At this point of time, only the toner particles are delivered to the toner carrying body by the electric field that is designed to deliver only the toner to the toner carrying body, so as to be supplied for the development of the electrostatic latent image. On the other hand, the carrier particles that is electrically charged to a polarity opposite to that of the toner particles are returned to the toner supply unit through the openings.

EMBODIMENT

An embodiment of the present invention will be described as follows.

Figure 2:
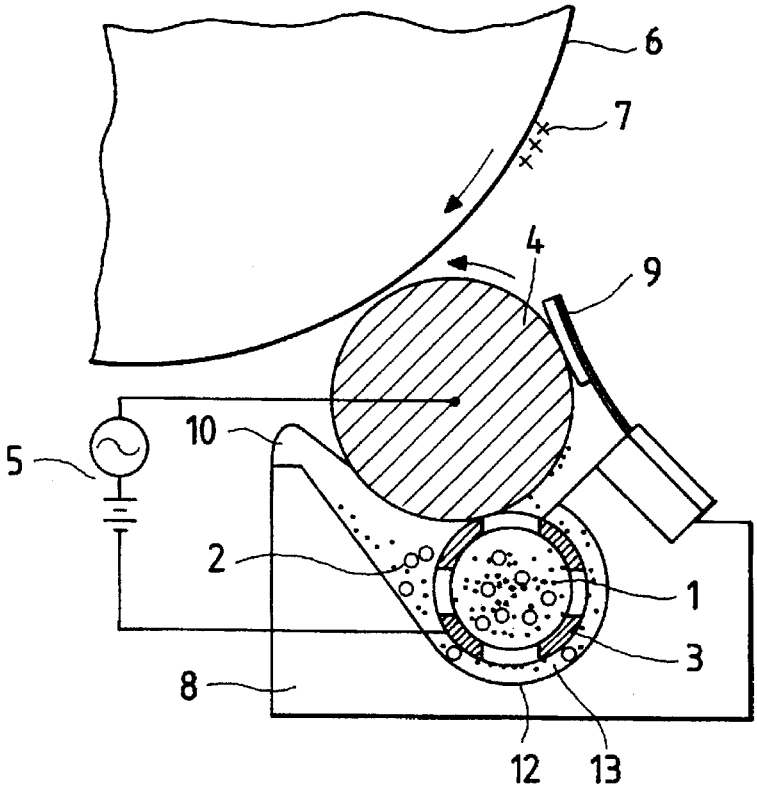
FIG. 2 is a schematic sectional diagram showing a developing apparatus, which is an embodiment of the invention.

FIG. 2 is a diagram illustrating a developing apparatus, which is an embodiment of the invention. In the drawing, reference numeral 1 designates a nonmagnetic toner; 2, a nonmagnetic resin carrier; 3, a developer forward member; 4, a toner carrying body; 5, a power supply serving unit for applying voltage; 6, an electrostatic latent image holding body comprising a negatively charged organic photosensitive body; 7, an electrostatic latent image formed on the holding body 6 by an ordinary method; 8, a frame of the apparatus; 9, a toner regulating member; and 10, a seal member.

Figure 3A:
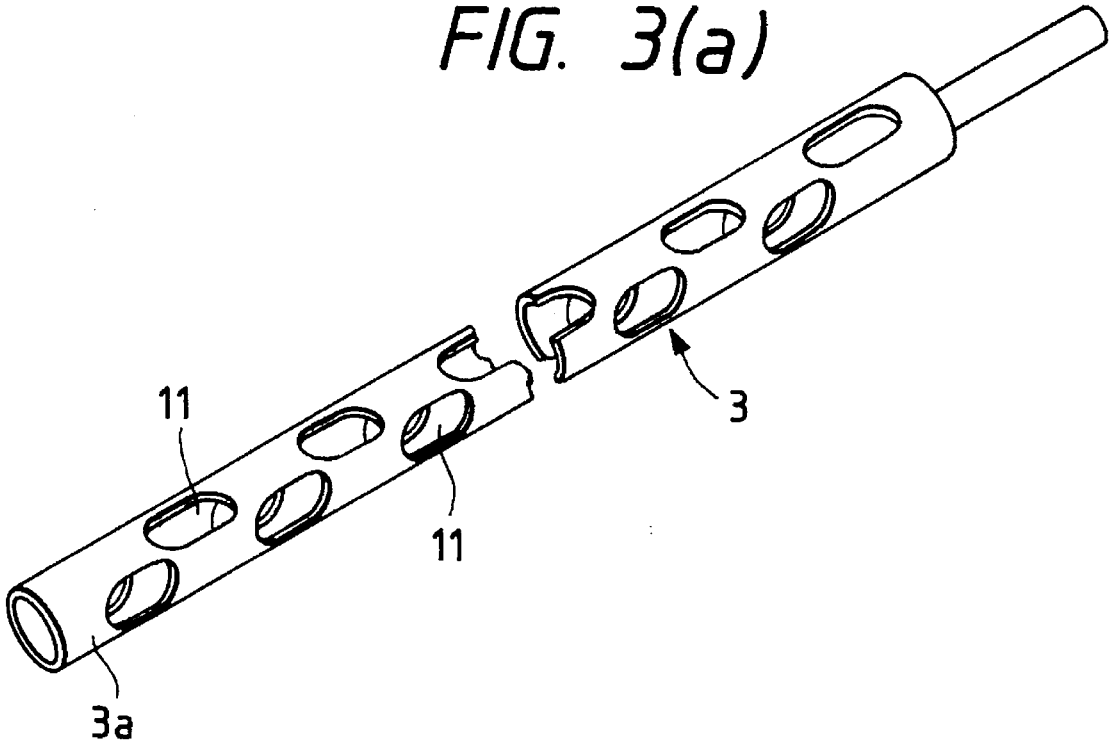
FIG. 3(*a*) is a perspective view of a main portion of an exemplary developer forward member.
Figure 3B:
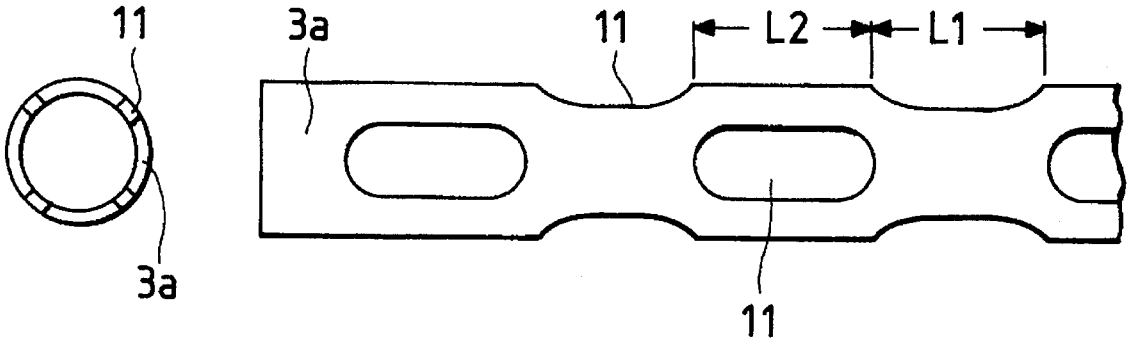

As shown in FIG. 3(*a*), the developer forward member 3 is a hollow stainless steel roll of 19 mmϕ having a plurality of oval openings 11. As shown in FIG. 3(*b*), the length L1 of the major axis of each opening 11, is equal to the length L2 between the openings. This forward member 3 is disposed so as to be apart from an inner wall surface 12 of the frame 8 of the apparatus by a gap of about 1 mm. The toner carrying body 4 is formed of an aluminum roll of 24 mmϕ with a semiconductive layer made from phenol resin arranged on the surface thereof, the volume resistivity thereof being $10^6$ Ω·cm. The toner carrying body 4 is disposed so as to be apart from the electrostatic latent image holding body 6 by a gap of about 200 μm. Further, the toner regulating member 9 is formed by bonding 1 mm-thick EPDM rubber to a 0.12 mm-thick stainless steel flat spring (SUS303), and is in pressure contact with the surface of the toner carrying body 4 under a contact pressure of 10 gf/cm.

On the other hand, the toner 1, the average particle diameter of which is 7 μm, is formed by externally adding hydrophobic silica comprising polyester resin. The resin carrier 2 is formed by adding a small amount of carbon black serving as a conductance imparting agent and aluminum stearate serving as an electric charge control agent into acrylic resin. The average particle diameter of the resin carrier 2 is 100 μm; apparent specific gravity thereof is 1.2 g/cm; and the volume resistivity thereof is $10^8$ Ω·cm.

The thus constructed developing apparatus is operated as follows.

The nonmagnetic toner 1 is forwarded into the hollow part of the developer forward member 3 that is in rotation from a not shown toner storage box disposed outside the developing apparatus, and is stirred thereat together with the nonmagnetic resin carrier 2 to be blended together. Simultaneously therewith, the toner 1 is electrically charged to a polarity opposite to that of the carrier 2. A developer comprising such electrically charged toner 1 and the resin carrier 2 is discharged outside from the openings 11 of the developer forward member 3, and further forwarded so as to move through a gap 13 between the surface of the forward member 3 and the inner wall surface 12 of the frame 8 of the apparatus. When the developer reaches a position where the developer confronts the toner carrying body 4 by the rotation of the developer forward member 3, the toner 1 in the developer is delivered to the toner carrying body 4 while attracted thereto by an electric field generated by voltage applied from the power supply 5, and the resin carrier 2 in the developer is forwarded while attracted toward the forward member 3 thereby. Accordingly, the electrically charged nonmagnetic toner 1 is formed into a thin layer. This toner is electrically charged again while subjected to rubbing by the regulating member 9 and formed into a thin layer again. When the toner 1 formed on the toner carrying body 4 in thin layer form is forwarded to a position where such toner confronts the electrostatic latent image holding body 6, the toner 1 flies over toward the holding body 6 by electrostatic attraction of the development bias voltage and adheres to the electrostatic latent image 7, thereby effecting development of the electrostatic latent image.

Next, by applying this developing apparatus to a examination copying machine (a modified FX6800 machine), copying examinations were carried out under the following development conditions.

(Development conditions)

- Process speed of the electrostatic latent image holding body 6: 160 mm/sec
- Number of revolutions of the toner carrying body 4: 200 rpm
- Number of revolutions of the developer forward member 3: 600 rpm
- Gap between the developer forward member 3 and the toner carrying body 4: about 1 mm
- Potential of the electrostatic latent image: −100 V
- Potential of background: −350 V
- Voltage applied from the power supply 5: Voltage obtained by superposing 2400 Vpp, 4 kHz AC voltage on −200 V DC voltage As a result of the above examination, satisfactorily reproduced images free from reduction in image density, impairment in image quality, and fog in background areas were obtained during the course of making 100 thousand copies, not to mention at an initial copying stage.

The following examinations were carried out using this developing apparatus.

Examination 1

The same copying operation as above was performed except that a plurality of resin carriers were used by changing the particle diameter of the above-mentioned resin carrier as appropriate within the range of from 20 to 700 μm.

As a result of this examination, satisfactory copy images were obtained with the resin carriers whose particle diameters were in the range of from 30 to 500 μm. However, in the case of the resin carrier whose particle diameter was 20 μm, a reduction in image density and adhesion of the carrier to the toner carrying body were observed, and in the case of the resin carrier whose particle diameter was 700 μm, impairment in electric charge was noticeable.

Examination 2

Figure 4:
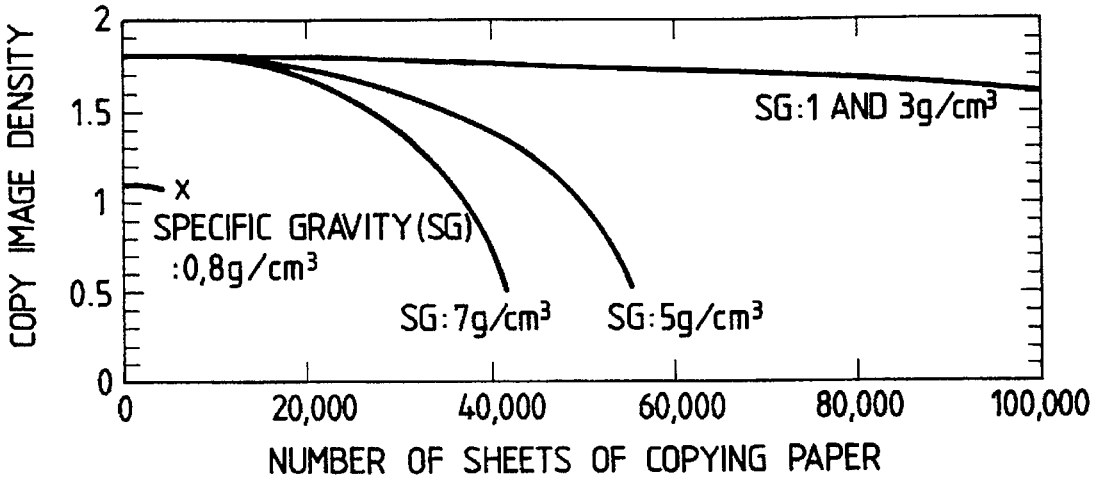
FIG. 4 is a graph showing measurements of examination 2.

The same coping operation as above was performed except that resin carriers, the apparent specific gravities(SG) of which were 0.8, 1, 3, 5, 7 g/cm$^3$, were used as the above-mentioned resin carrier. The copy image densities were measured. The results of the measurement are shown in FIG. 4. Particularly, in the case of the resin carrier whose apparent specific gravity was 0.8 g/cm$^3$, the copy image density was low, and the obtained copies were so defective even at the initial stage of the copying operation that the examination could not be continued.

Examination 3

Figure 5:
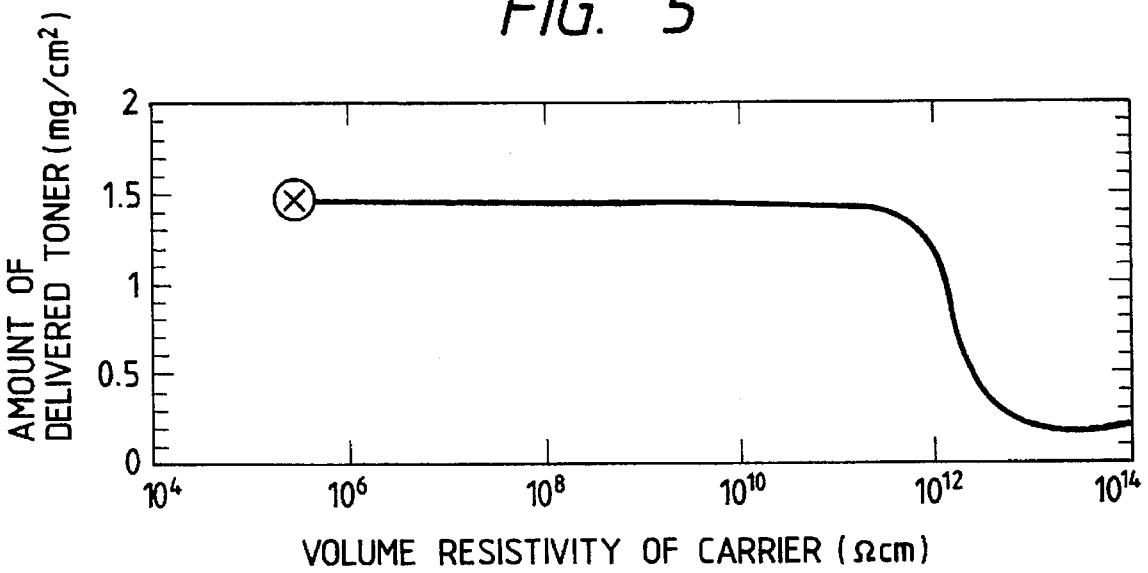
FIG. 5 is a graph showing measurements of examination

The same copying operation as above was performed except that a plurality of resin carriers were used by changing the volume resistivity of the above-mentioned resin carrier as appropriate. The amounts of toner delivered to the toner carrying body 4 were measured. The results are shown in FIG. 5.

As described in the foregoing, the developing apparatus of the present invention uses the nonmagnetic resin carrier, arranges the developer forward member so as to confront the toner carrying body and so as to be close to the inner wall surface of the frame of the apparatus, and generates the predetermined electric field between the developer forward member and the toner carrying body. As a result of this construction, the following advantages can be obtained.

Not only the nonmagnetic toner can be supplied to the toner carrying body stably and the toner can be electrically charged sufficiently, but also satisfactory noncontact development can be effected by the nonmagnetic toner. Therefore, excellent images that are free from reduction in image density, fog in background areas, and sweep pattern can be produced. Moreover, the simple design contributes to achieving a downsized, inexpensive developing apparatus.

The foregoing description of the embodiment of the present invention has been presented for purposes of illustration and description. It is not intended to be exhaustive or to limit the invention to the precise form disclosed, and obviously many modifications and variations are possible in light of the above teachings or may be acquired from practice of the invention. The embodiment was chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A developing apparatus for developing an electrostatic latent image on an electrostatic latent image holding body in a noncontact manner using a nonmagnetic toner carried on a toner carrying body disposed so as to confront the electrostatic latent image holding body, wherein a nonmagnetic resin carrier is used as a carrier for the nonmagnetic toner;

a developer forward member is disposed so as to confront the toner carrying body with a gap interposed therebetween and so as to arrange a part of the surface thereof close to an inner wall surface of a frame of the apparatus, the developer forward member having a conductive surface and forwarding a developer composed of the toner and the resin carrier by stirring, the inner wall surface having a surface profile corresponding to a surface profile of the developer forward member; and a voltage applying means applies such a voltage as to generate an electric field for attracting the toner in the developer toward the toner carrying body and attracting the resin carrier toward the developer forward member in an area where the toner carrying body confronts the developer forward member.

2. A developing apparatus according to claim 1, wherein the gap between the developer forward member and the toner carrying body is from 0.5 to 2.0 mm.

3. A developing apparatus according to claim 1, wherein the average particle diameter of the nonmagnetic resin carrier is from 30 to 500 μm by volume.

4. A developing apparatus according to claim 1, wherein the apparent specific gravity of the nonmagnetic resin carrier is from 1 to 3 g/cm$^3$.

5. A developing apparatus according to claim 1, wherein the volume resistivity of the nonmagnetic resin carrier is from $10^6$ to $10^{12}$ Ω·cm.

6. A developing apparatus for developing an electrostatic image, the developing apparatus comprising:

rotatable toner carrying means for supplying a toner for developing an electrostatic image;

rotatable developer forward means for forwarding and supplying a toner to the toner carrying means;

a developer forward passage disposed around said developer forward means;

electric field generating means for generating an electric field for delivering the toner to the toner carrying means; and toner supply means containing therein developer comprising the toner and a carrier comprising nonmagnetic particles, the toner supply means including a stirring area where the developer is stirred; a forward force imparting area where a forward force is imparted to the developer to allow the developer to be supplied to the forward passage; and a toner supply area where the developer is caused to confront the toner carrying means; the toner supply means comprising a cylindrical member having a circumference with openings thereon.

7. A developing apparatus according to claim 6, wherein the carrier contains a resin.

8. A developing apparatus according to claim 6, wherein the apparent specific gravity of the carrier is from 1 to 3 g/cm$^3$.

9. A developing apparatus for developing an electrostatic image the developing apparatus comprising:

rotatable toner carrying means for supplying a toner for developing an electrostatic image;

rotatable developer forward means for forwarding and supplying a toner to the toner carrying means;

a developer forward passage disposed around said developer forward means;

electric field generating means for generating an electric field for delivering the toner to the toner carrying means; and toner supply means containing therein developer comprising the toner and a nonmagnetic resin carrier, the toner supply means including a stirring area where the developer is stirred; a forward force imparting area where a forward force is imparted to the developer to allow the developer to be supplied to the forward passage; and a toner supply area where the developer is caused to confront the toner carrying means; the volume resistivity of the carrier being from $10^6$ to $10^{12}$ Ω·cm.

10. A developing apparatus according to claim 9, wherein the carrier comprises nonmagnetic particles.

11. A developing apparatus according to claim 10, wherein the carrier contains a resin.

12. A developing apparatus according to claim 10, wherein the apparent specific gravity of the carrier is from 1 to 3 g/cm$^3$.

13. An image forming apparatus for developing an electrostatic latent image, comprising:

electrostatic latent image holding means for holding said electrostatic latent image;

toner carrying means for carrying a nonmagnetic toner, being disposed to confront the electrostatic latent image holding means;

developer forward means for stirring a developer including the nonmagnetic toner and a nonmagnetic resin carrier, and forwarding the developer, being disposed to confront said toner carrying means with a gap interposed therebetween;

an inner wall surface of a frame of the apparatus having a surface profile corresponding to a surface profile of said developer forward means, to which a part of said developer forward means is disposed closely; and voltage applying means for applying a voltage to generate an electric field for attracting the toner in the developer toward the toner carrying means in an area where the toner carrying means confronts the developer forward means.

14. An image forming apparatus according to claim 13, wherein the toner is electrically charged to a polarity opposite to that of the carrier in said developer forward means.

15. An image forming apparatus according to claim 13, wherein said developer forward means comprises a cylindrical member having a plurality of openings.

16. An image forming apparatus according to claim 13, wherein said toner carrying means has a regulating means being attached compressedly onto the surface thereof, for repeating the electrical charging of the toner and the forming of a thin layer of the toner.

17. An image forming apparatus according to claim 13, wherein the gap between the developer forward means and the toner carrying means is from 0.5 to 2.0 mm.

18. An image forming apparatus according to claim 13, wherein the average particle diameter of the nonmagnetic resin carrier is from 30 to 500 μm by volume.

19. An image forming apparatus according to claim 13, wherein the apparent specific gravity of the nonmagnetic resin carrier is from 1 to 3 g/cm$^3$.

20. An image forming apparatus according to claim 13, wherein the volume resistivity of the nonmagnetic resin carrier is from $10^6$ to $10^{12}$ Ω·cm.

* * * * *